United States Patent [19]

Joffe

[11] Patent Number: 4,887,874

[45] Date of Patent: Dec. 19, 1989

[54] KNOCKDOWN DRAWERS AND BINS

[76] Inventor: Edward J. Joffe, 940 Park Ave., Linden, N.J. 07036

[21] Appl. No.: 324,465

[22] Filed: Mar. 16, 1989

[51] Int. Cl.[4] ..... A47B 43/00

[52] U.S. Cl. ..... 312/258; 220/403; 220/4 F; 220/6; 312/330.1

[58] Field of Search ..... 312/258, 259, 261, 262, 312/330 R; 220/403, 4 F, 6, 7

[56] References Cited

U.S. PATENT DOCUMENTS

| | | | |
|---|---|---|---|
| 964,121 | 7/1910 | Rose | 220/7 |
| 3,497,127 | 2/1970 | Box | 220/6 X |
| 3,675,808 | 7/1972 | Brink | 220/7 |
| 4,453,875 | 6/1984 | Johnson | 220/403 |
| 4,572,593 | 2/1986 | Takamizawa et al. | 312/255 X |

*Primary Examiner*—Joseph Falk

*Attorney, Agent, or Firm*—Peter L. Klempay

[57] ABSTRACT

Knockdown units forming drawers or bins include a one-piece molded plastic bottom and side panel unit with the side panels being connected to the bottom panel by reduced thickness thickness zones and molded plastic front and rear panels. Interengaging connecting means are formed integrally at the upper portions of the side panels and the upper ends of the front and rear panels.

6 Claims, 13 Drawing Sheets

KNOCKDOWN DRAWERS AND BINS

The present invention pertains to knockdown or collapsible drawers and bins and, more particularly, to such drawers and bins which are of molded plastic construction.

My copending application Ser. No. 324464, filed concurrently herewith, entitled INTERCONNECTING PANELS FOR KNOCKDOWN STRUCTURES, discloses knockdown cabinet frame constructions adapted for use with the drawers of the present invention to form knockdown file or storage cabinets and the like.

BACKGROUND OF THE INVENTION

Knockdown construction of furniture components is advantageous as such construction permits the compact storage and shipping of the components. This is particularly true in the case of drawers and bins which, in the assembled configuration, have large empty interior volumes. Numerous interconnecting arrangements for the components of knockdown structures have been devised. Many of these arrangements, however, involve the use of separate fasteners which adds to both the cost of the component and the complexity of its assembly by, for example, requiring the use of tools such as screwdrivers and wrenches or pliers.

It is the primary objet of the present invention to provide drawer and bin components for knockdown furniture which components include integral connectors.

It is also an object of the present invention to provide such drawers and bins which are assembled without the use of tools.

It is a further object of the present invention to provide such drawers and bins of molded plastic construction.

SUMMARY OF THE INVENTION

The above and other objects of the present invention which will become apparent hereinafter are achieved by the provision of knockdown drawer and bin constructions which include a unitary molded plastic component having a central panel constituting the bottom wall of the drawer or bin and a pair of side-wall panels extending from opposite lateral edges of the central panel and connected thereto by integral plastic hinges; and a pair of molded plastic end panels constituting, respectively, the front and rear walls of the construction; each of the end panels having, adjacent each of the upper corners thereof, at least one opening and each side-wall panel having, adjacent each of the upper corners thereof, a lug adapted to engage the opening and an integral spring latch for retaining the end panel in position. In a first embodiment of the invention, the end panels extend across only the upper portions of the drawer or bin and a one-piece liner is provided within the confines of the structure formed by the interconnected panels. In alternate embodiments, the end panels extend downwardly to and engage the floor of the drawer or bin.

For a more complete understanding of the invention and the objects and advantages thereof, reference should be had to the accompanying drawings and the following detailed description wherein preferred embodiments of the invention are illustrated and described.

DESCRIPTION OF THE PREFERRED EMBODIMENTS

Figure 1:
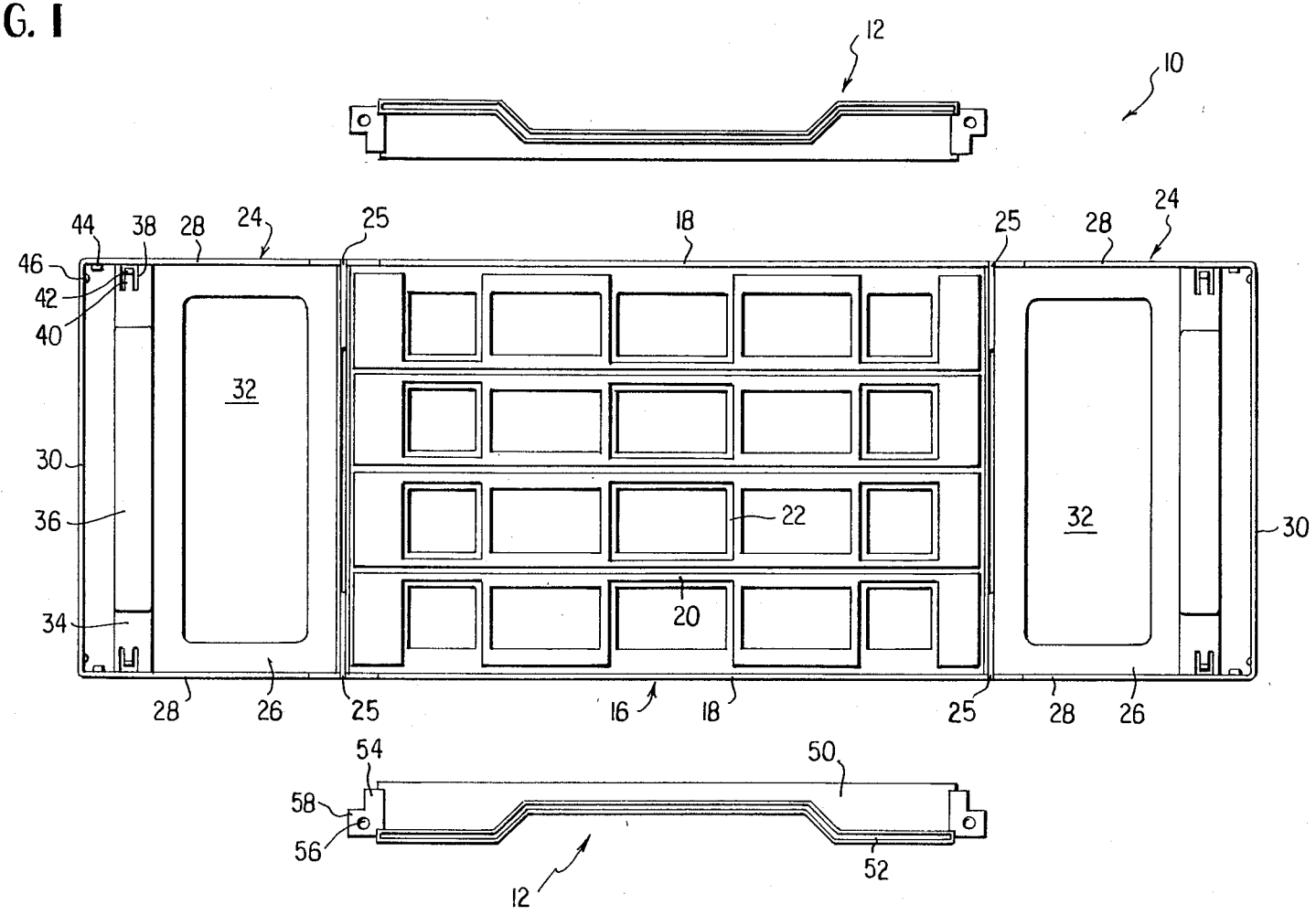
FIG. 1 is a top plan view of the molded plastic components of the first embodiment of the knockdown drawer or bin of the present invention.

The embodiment of the invention illustrated in FIGS. 1 through 7 is a knockdown drawer designed for use with the knockdown frame disclosed in my above-referenced copending application Ser. No. 324464, filed concurrently herewith and entitled INTERCONNECTING PANELS FOR KNOCKDOWN STRUCTURES, the frame and drawers forming a knockdown file cabinet.

In the following description of the disclosed embodiments, the various terms of orientation, such as front, rear, inner, outer, are to be considered with reference to the drawers as assembled.

The drawer is formed of four components, a one-piece molded plastic bottom and side panel unit 10, a pair of one-piece molded plastic front and rear panel members 12, and a liner 14. Unit 10 includes a rectangular center panel 16 which constitutes the bottom wall of the drawer and is, preferably, of open grid configuration for economy of material, having upwardly extending side flanges 18, longitudinal ribs 20 and transverse ribs 22. Side panels 24 extend from opposite sides of the center panel, being connected thereof by regions 25 of reduced thickness functioning as hinges. The two side panels are identical, each having a side wall 26, end flanges 28 projecting from the lateral edges of the side wall, and a top flange 30 projecting from the top edge of the side wall. As can be seen from FIGS. 3 and 4, the flanges 18, 28 and 30 are of uniform height and the adjacent ends of the flanges 18 and 28 are angled at 45°. A central opening 32 may be provided in each of the side panel walls 26. Adjacent the outer or upper end of each side panel 24, the wall 26 is offset inwardly to form a channel 34 extending the width thereof. This channel may be of uniform depth or, as is shown, may include a central portion 36 further offset from the outer face of the panel. Each end of the rear wall of the channel 34 includes a U-shaped notch 38 forming a tab 40 the tip of which has an inwardly directed projection 42. On the inner face of each end flange 28 above the channel 34 there is formed an inwardly projecting circular lug 44. A further lug 46 is provided at the juncture of the top flange 30 and side wall 26 offset from the end flange 28. On the outer face of the side panel 24 there is provided an outwardly projecting rib 48 located midway between the lateral edges of the panel and at the lower end thereof.

The front and rear wall members 12 are identical. Each member 12 is an elongated bar 50 having a stiffening flange 52 projecting from the upper edge thereof and, at each end of the bar, an end tab 54, the outer surface of which is offset from the outer surface of the bar by a distance equal to the thichness of the end flanges 28 of the side panels. The end tab is of inverted L-shape configuration and has a circular through hole 56 in the outwardly extending end 58 thereof.

The liner 14 may be formed of cardboard, plastic or other sheet material and is of single piece construction. The liner includes a center panel 60 defined by longitudinal and transverse fold lines 62 and 64 and sized to fit the center panel 16 within the confines of the side flanges 18. Side panels 66 of the liner fit within the side panels 24 below the flange 34. The front and rear panels 68 of the liner have the outer edges thereof notched to conform to the front and rear panels 12 of the assembled drawer.

Figure 2:
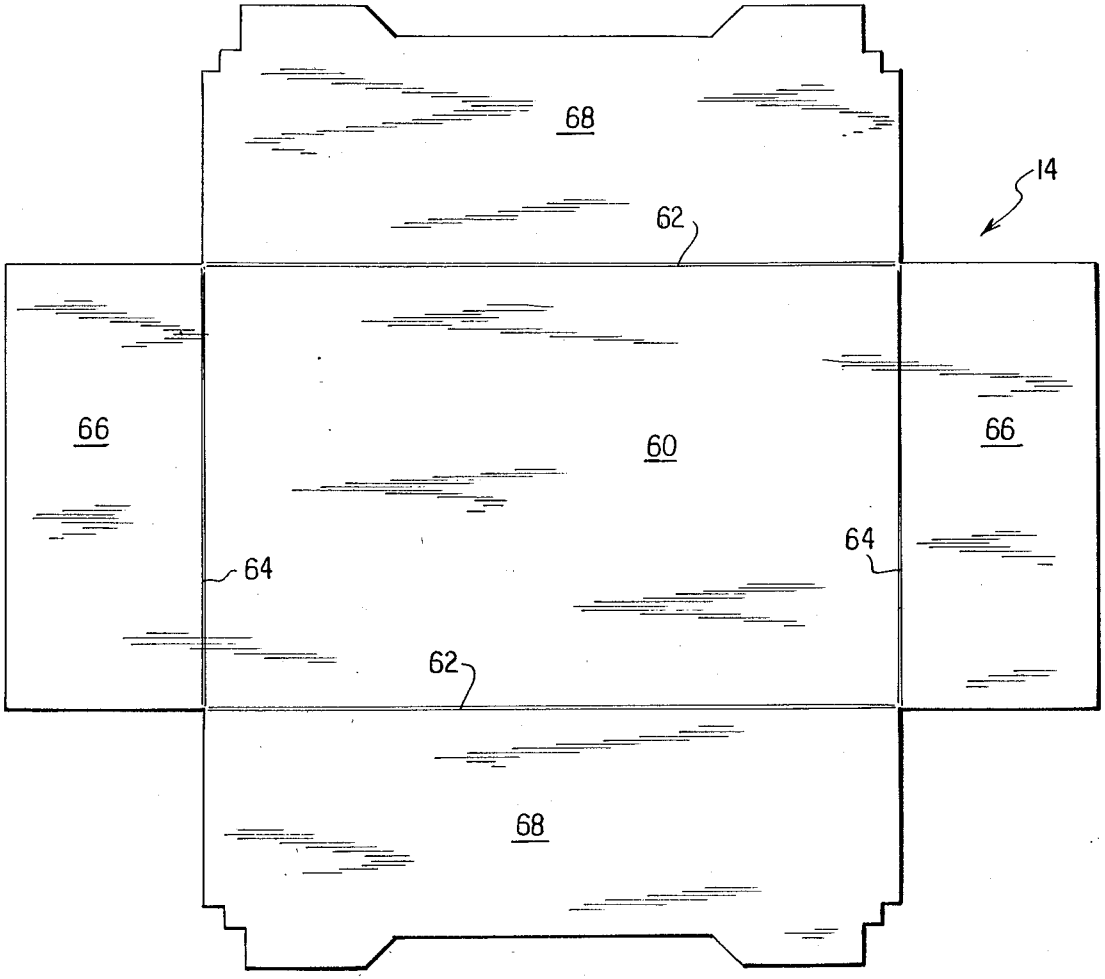
FIG. 2 is a plan view of the liner used with the components of FIG. 1.
Figure 3:
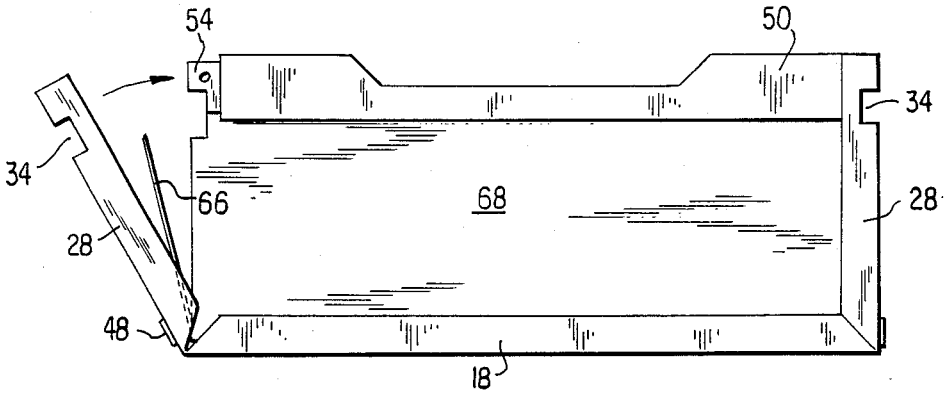
FIG. 3 is a front elevational view of the first embodiment of the drawer or bin, one side-wall panel being shown in an intermediate position in the process of assembly.
Figure 4:
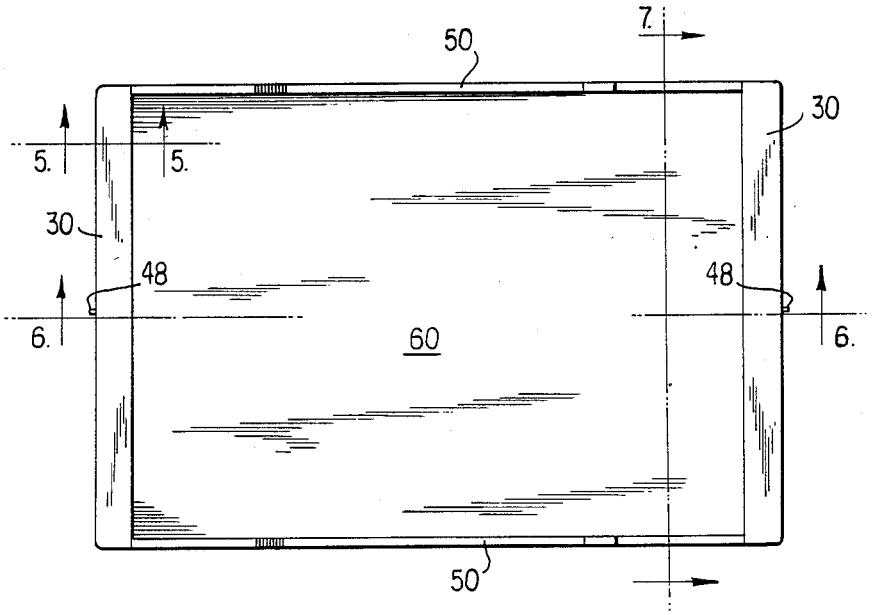
FIG. 4 is a top plan view of the assembled drawer.

The drawer in the knockdown state as shown in FIGS. 1 and 2 may be compactly packaged, shipped and stored. When packaging the liner 14, the side panels 66 may be folded against one face of the center panel 60 and the front rear panels 68 folded against the opposite face to reduce the overall size thereof.

Figure 5:
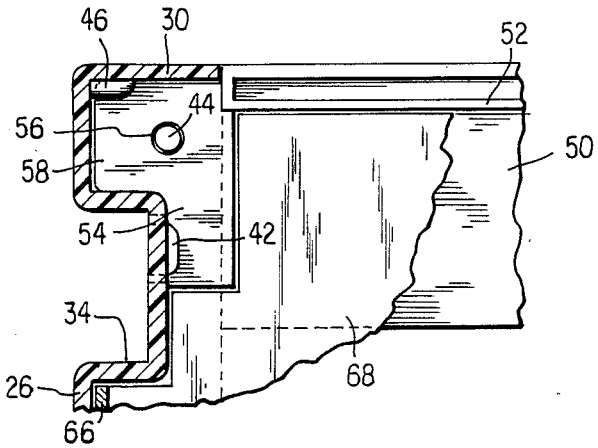
FIG. 5 is a fragmentary cross sectional view taken on the line 5—5 of FIG. 4, on an enlarged scale relative thereto.
Figure 6:
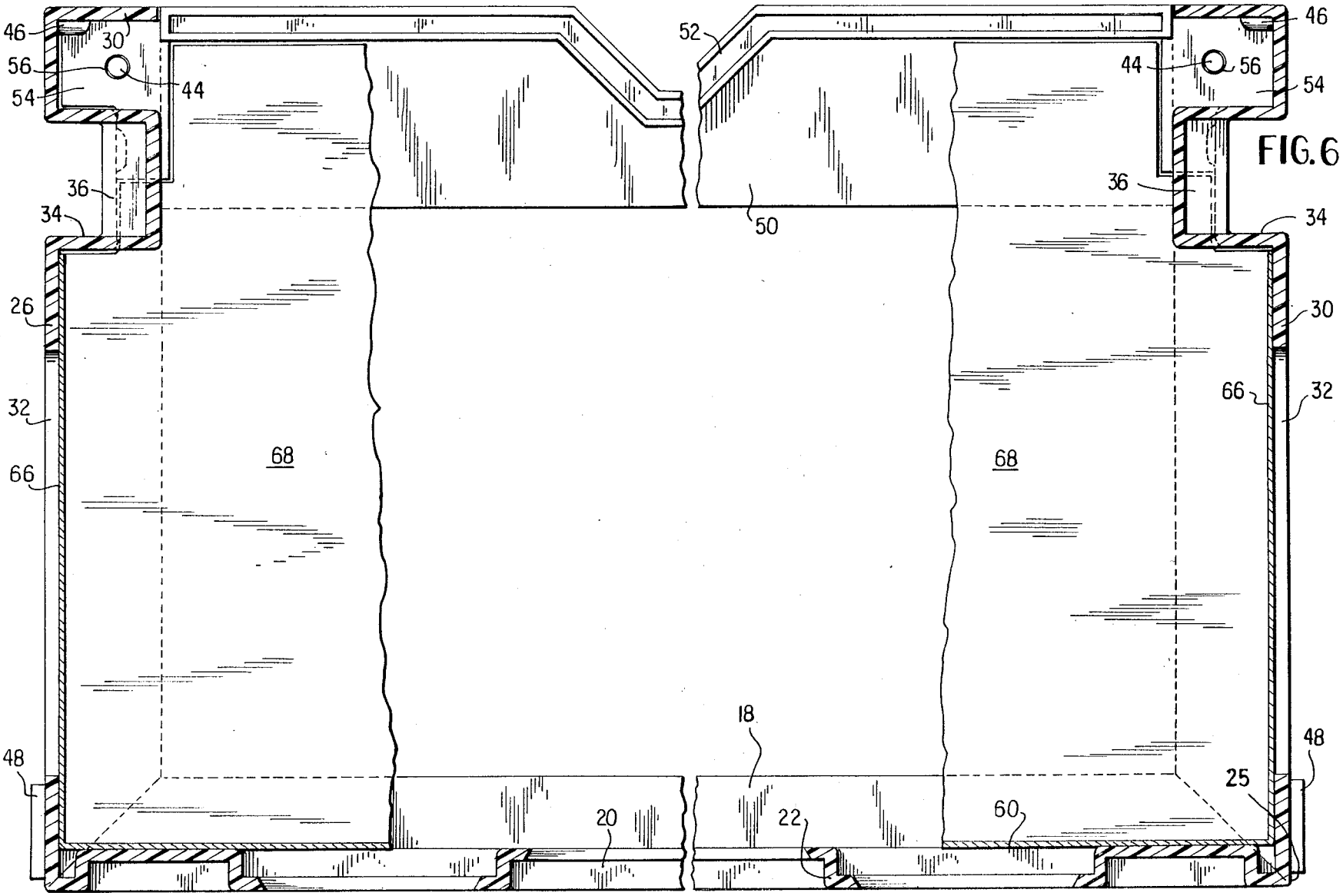
FIGS. 6 and 7 are transverse cross sectional view taken on the lines 6—6 and 7—7, respectively, of FIG. 4, with portions being broken away and on an enlarged scale relative thereto.
Figure 7:
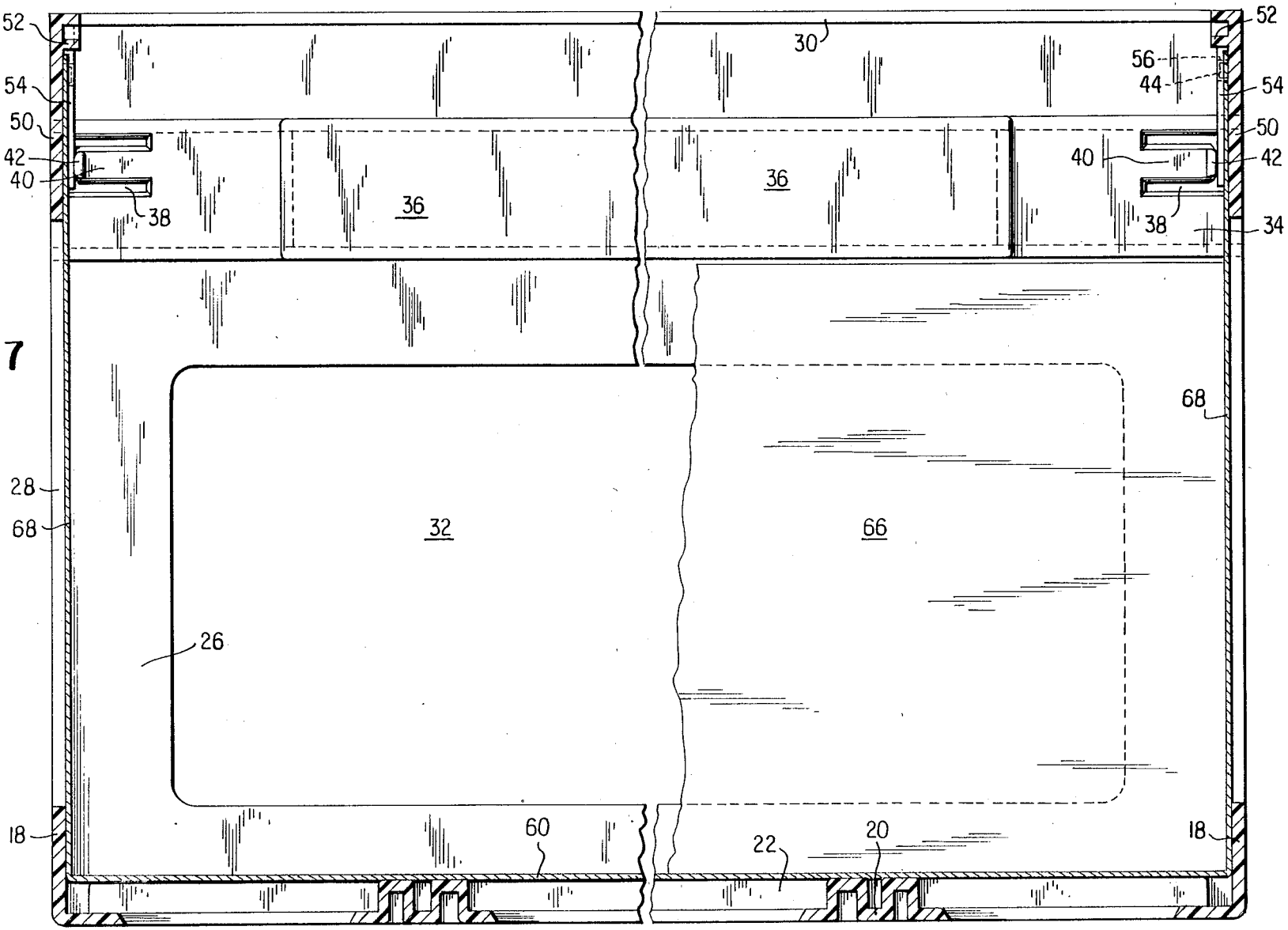
Figure 8:
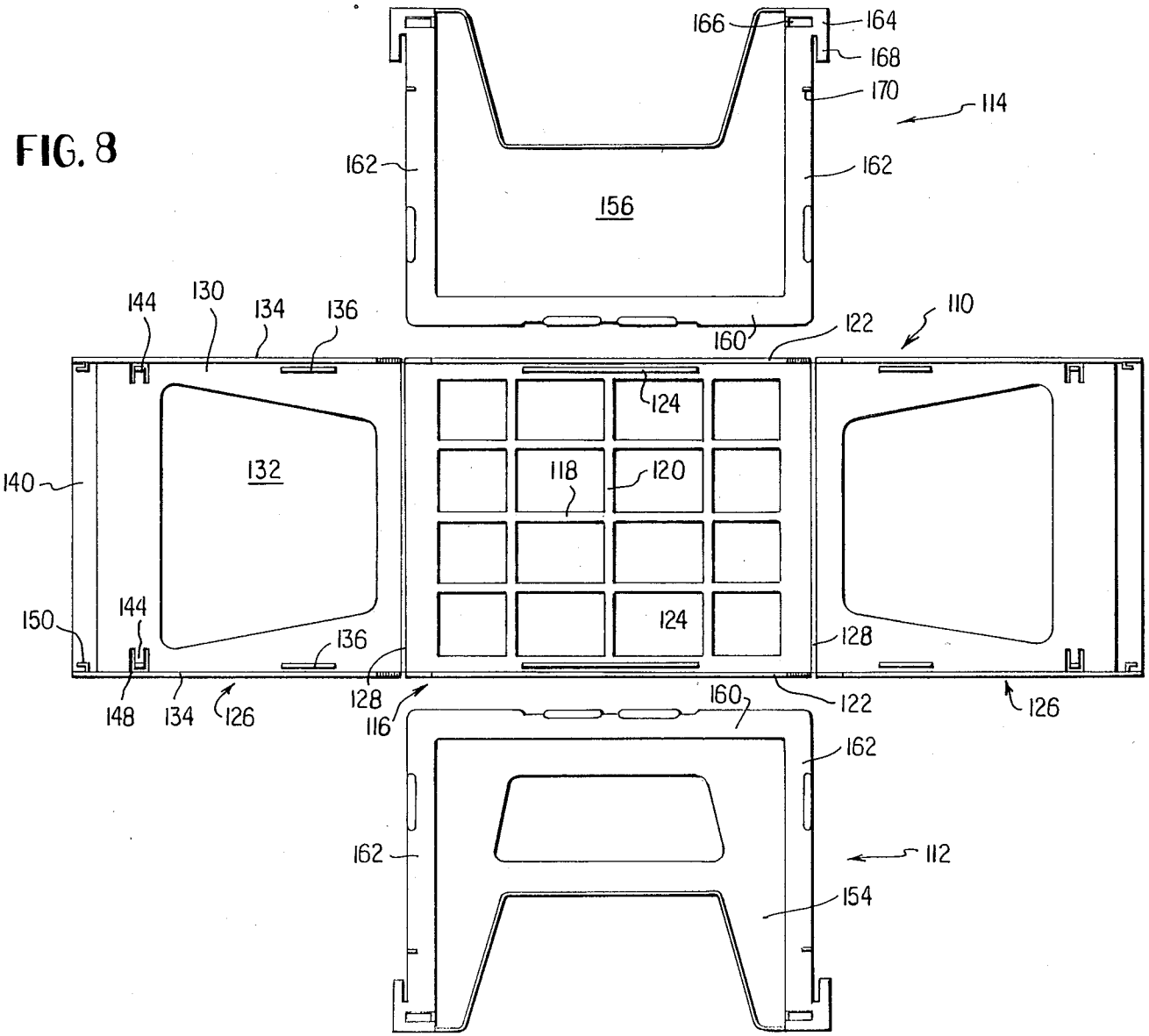
FIG. 8 is a top plan view of the molded plastic components of the second embodiment of the knockdown drawer or bin.
Figure 9:
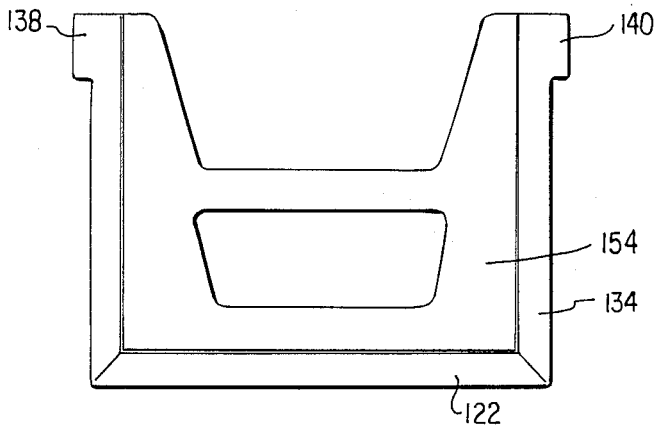
FIG. 9 is a front elevational view of the drawer or bin of FIG. 8.
Figure 10:
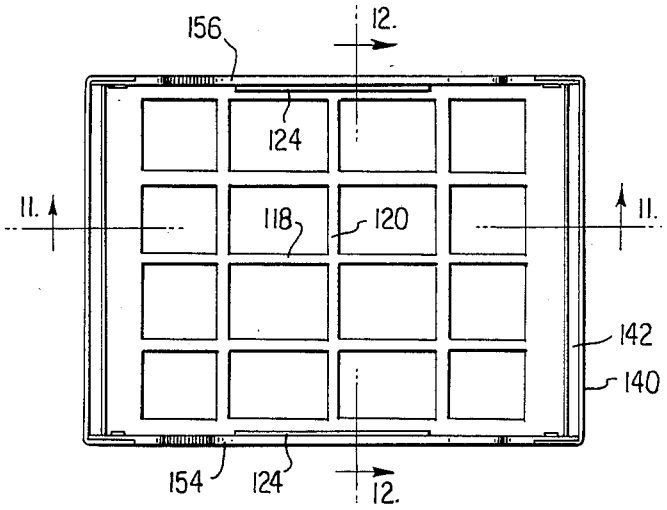
FIG. 10 is a top plan view thereof.
Figure 13:
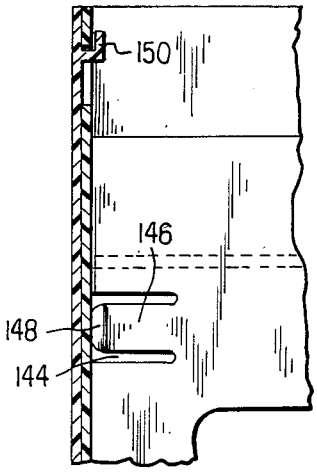
FIG. 13 is a fragmentary cross sectional view taken on the line 13—13 of FIG. 11.

Erection of the drawer involves connecting the front and rear wall members 12 to one of the side panels 24 by manipulating the member 12 to position the end tab 54 at an inner, upper corner of the panel 24 with the circular lug 44 projecting through the hole 56 and with the outwardly extending end 58 positioned between the side wall 28 and the lug 46. The retaining tab 40 has sufficient resiliency as to permit this tab to be pushed outwardly to permit the end tab 54 to clear the projection 42 during the assembly process. When the retaining tab 40 is released, the projection 42 moves inwardly to contact the inner face of the end tab 54 as can be seen in FIGS. 5 and 6. Following connection of the two members 12 to one side panel 24, the liner 14 is placed on top of the center panel 16 and the two end panels 24 are swung upwardly, as indicated by the arrow in FIG. 3, bringing the second end tabs 54 of the members 12 into position for attachment to the second side panel 24 to complete the assembly process.

As was mentioned above, the drawer may be used with the frames disclosed in my copending application. FIGS. 7–11 of that application illustrate the manner of use of the drawers in such frames. The channels 34 of the drawer side panels are configured to receive the U-shaped rails of the frame side panels to support the drawers in the frame. The projecting ribs 48 at the lower ends of the side panels of the drawers function as stops to limit the extent to which the drawers may be opened.

Figure 11:
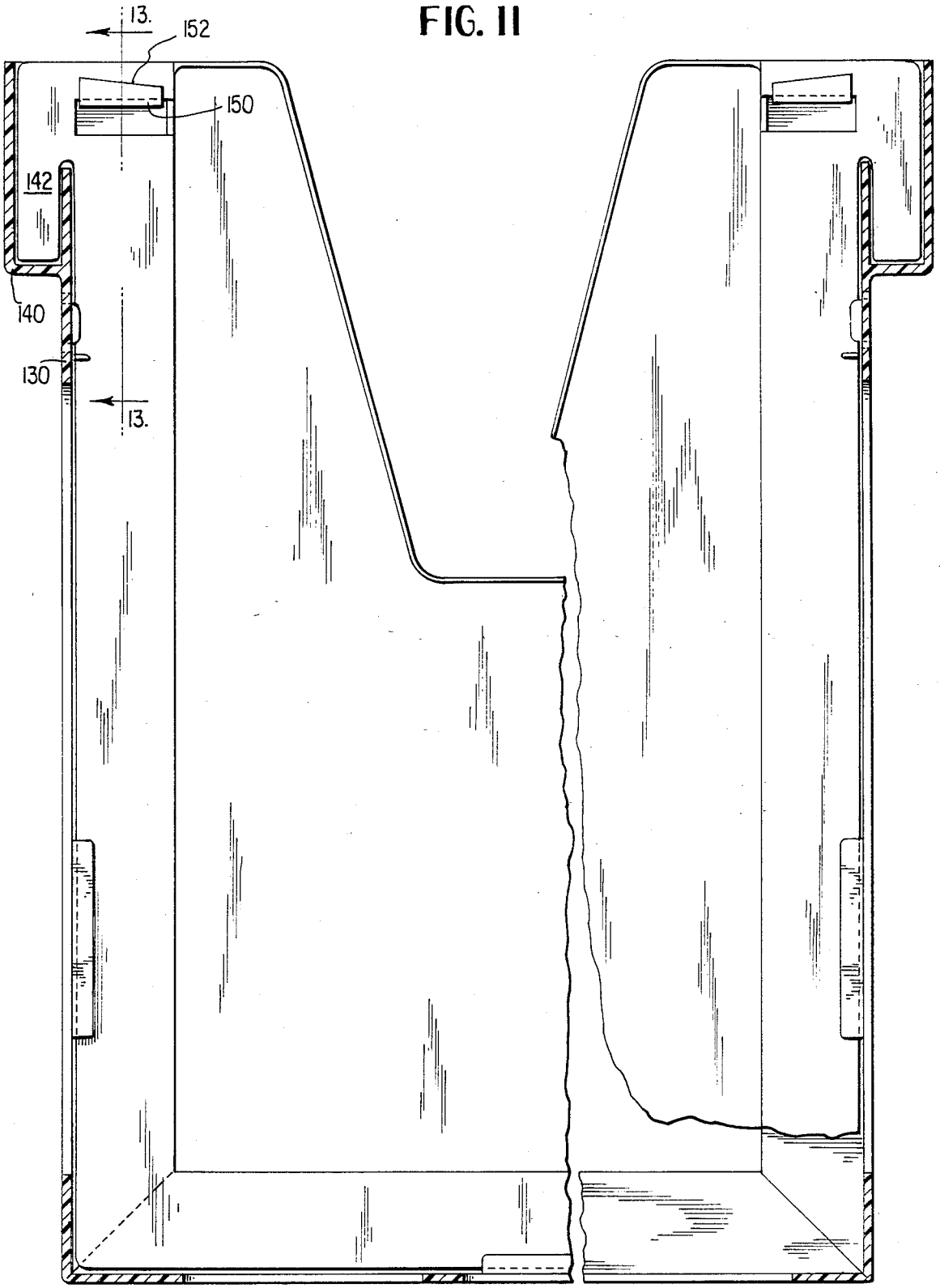
FIGS. 11 and 12 are transverse cross sectional views taken on the lines 11—11 and 12—12, respectively, of FIG. 10, with portions being broken away and on an enlarged scale relative thereto.

A second embodiment of the knockdown drawer of the invention is illustrated in FIGS. 8 through 13. The drawer of this embodiment consists of three components, a one-piece molded plastic bottom and side panel unit 110, a one-piece molded plastic front panel 112 and a one-piece molded plastic rear panel 114. As in the previously described embodiment, the unit 110 has a rectangular center panel 116 forming the bottom wall of the drawer. The panel 116 may be of open grid configuration with longitudinal and transverse ribs 118, 120 and has upwardly extending side flanges 122. Inwardly of the midportion of each side flange and extending in spaced, parallel relation thereto are upwardly projecting ribs 124. Side panels 126 extend from opposite sides of the center panel 116, bing connected thereto by reduced thickness hinge zones 128. The side panels are identical, each having a side wall 130 which may be provided with a central opening 132. End flanges 134 extend along the lateral edges of the side wall 130, the flanges 122 and 134 being of the same height and having the adjacent ends thereof angled at 45°. Inwardly projecting rib 136 which extends in spaced, parallel relation to the flanges 134 are provided at locations approximately one-fourth the height of the side panels. As can be seen from FIGS. 9 and 12, the upper end portions 138 of the flanges 134 are widened, projecting outwardly of the side wall 130 and extend upwardly above the upper end of the wall 130. An upper end wall 140 extends between the upper flange portions 138 and forms, with the upper end of the wall 130, an upwardly opening channel 142. A short distance below the lower end of the upper wall 140, the wall 130 has, at each side thereof, a U-shaped notch 144 forming a retaining tab 146 provided with an inwardly extending end projection 148. On the inner face of each end flange 134 adjacent the upper end thereof is provided an elongated projection 150 of L-shaped cross section, the vertical wall 152 of which tapers, as is shown in FIG. 11.

Figure 12:
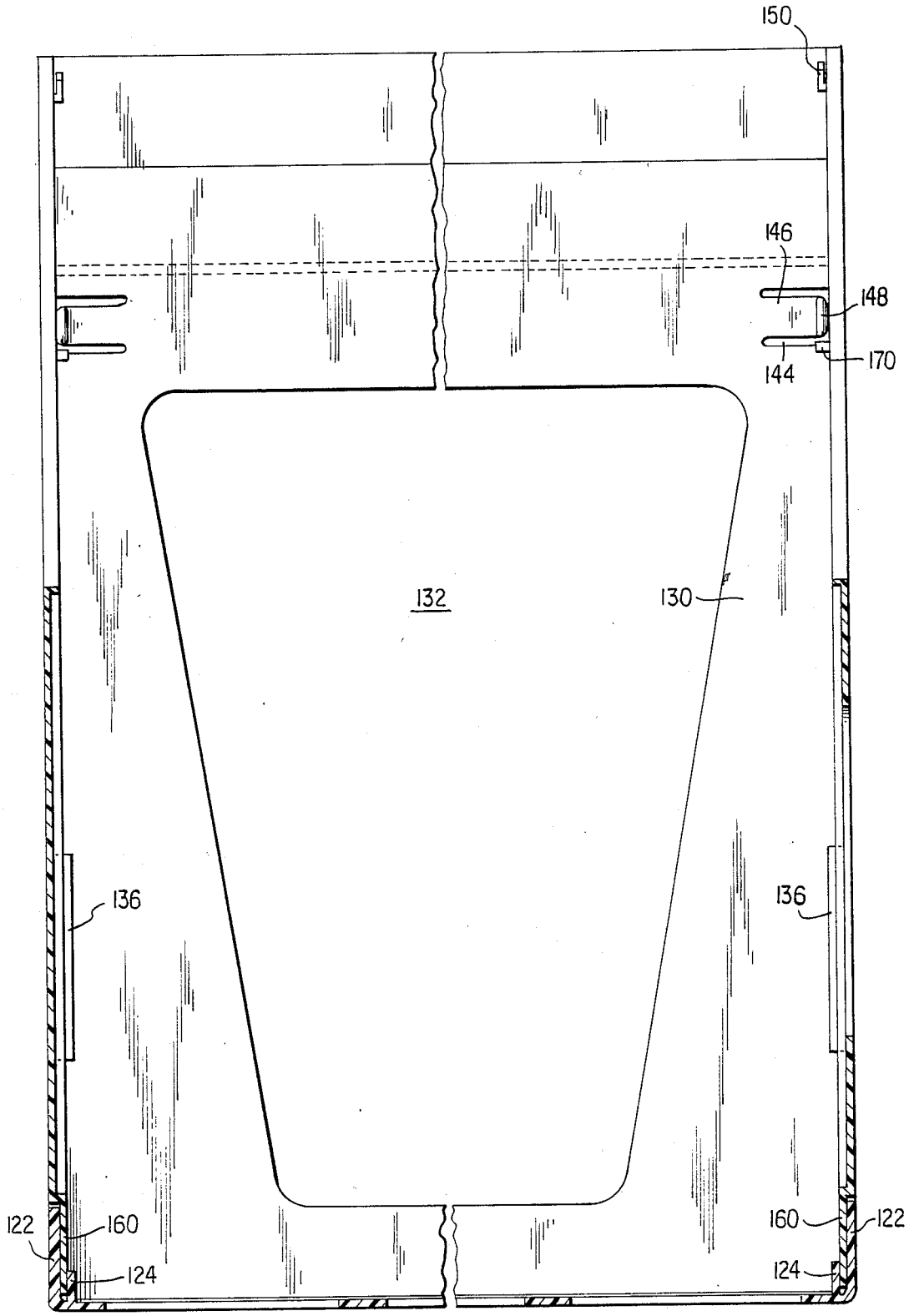
Figure 14:
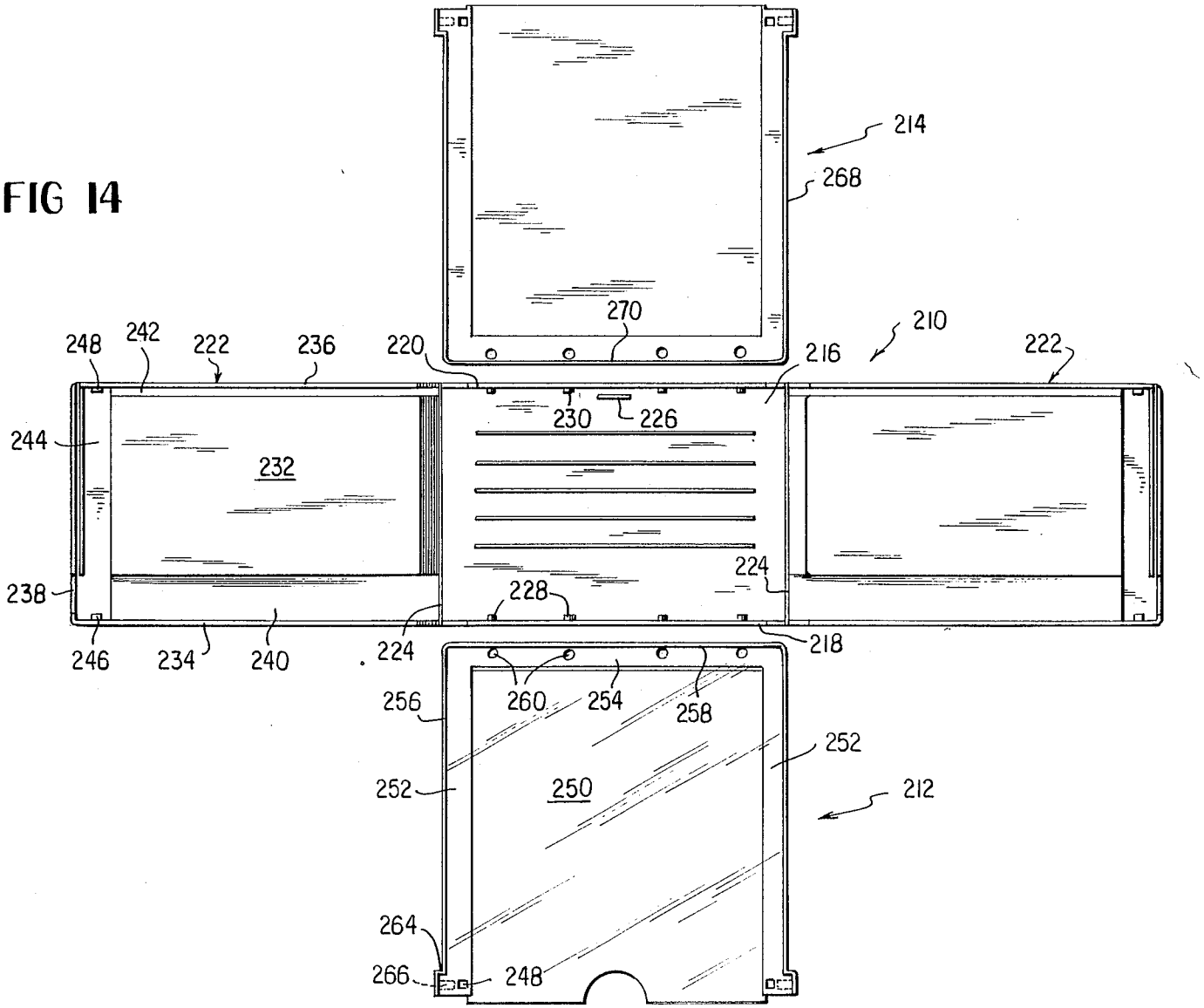
FIG. 14 is a top plan view of the molded plastic components of the third embodiment of the knockdown drawer or bin.
Figure 15:
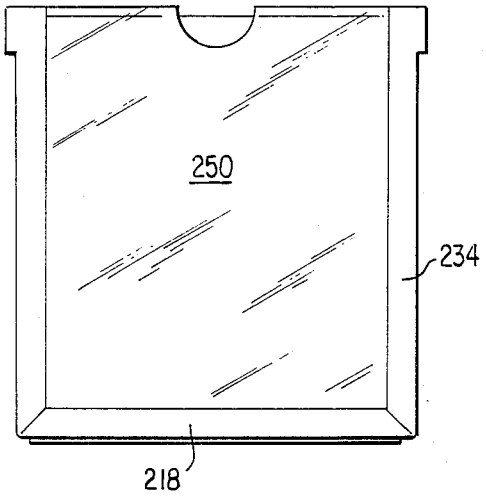
FIG. 15 is a front elevational view thereof.
Figure 16:
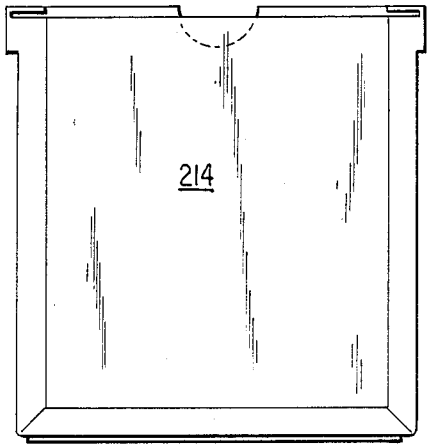
FIG. 16 is a rear elevational view thereof.
Figure 17:
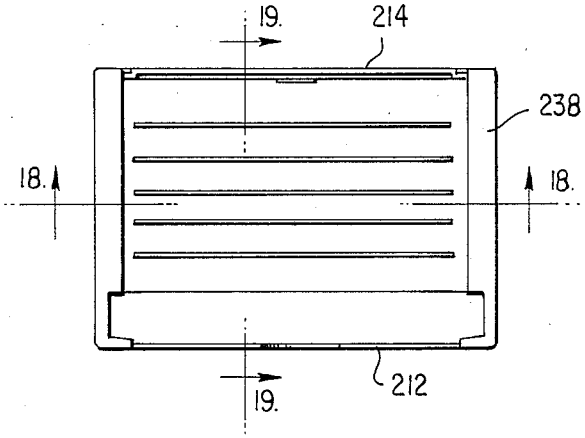
FIG. 17 is a top plan view thereof.
Figure 20:
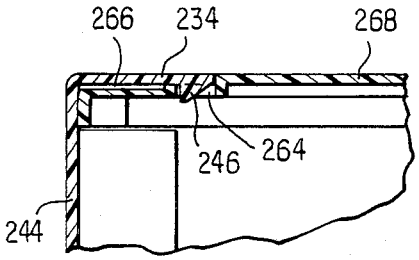
FIG. 20 is a fragmentary cross sectional view taken on the line 20—20 of FIG. 18.
Figure 18:
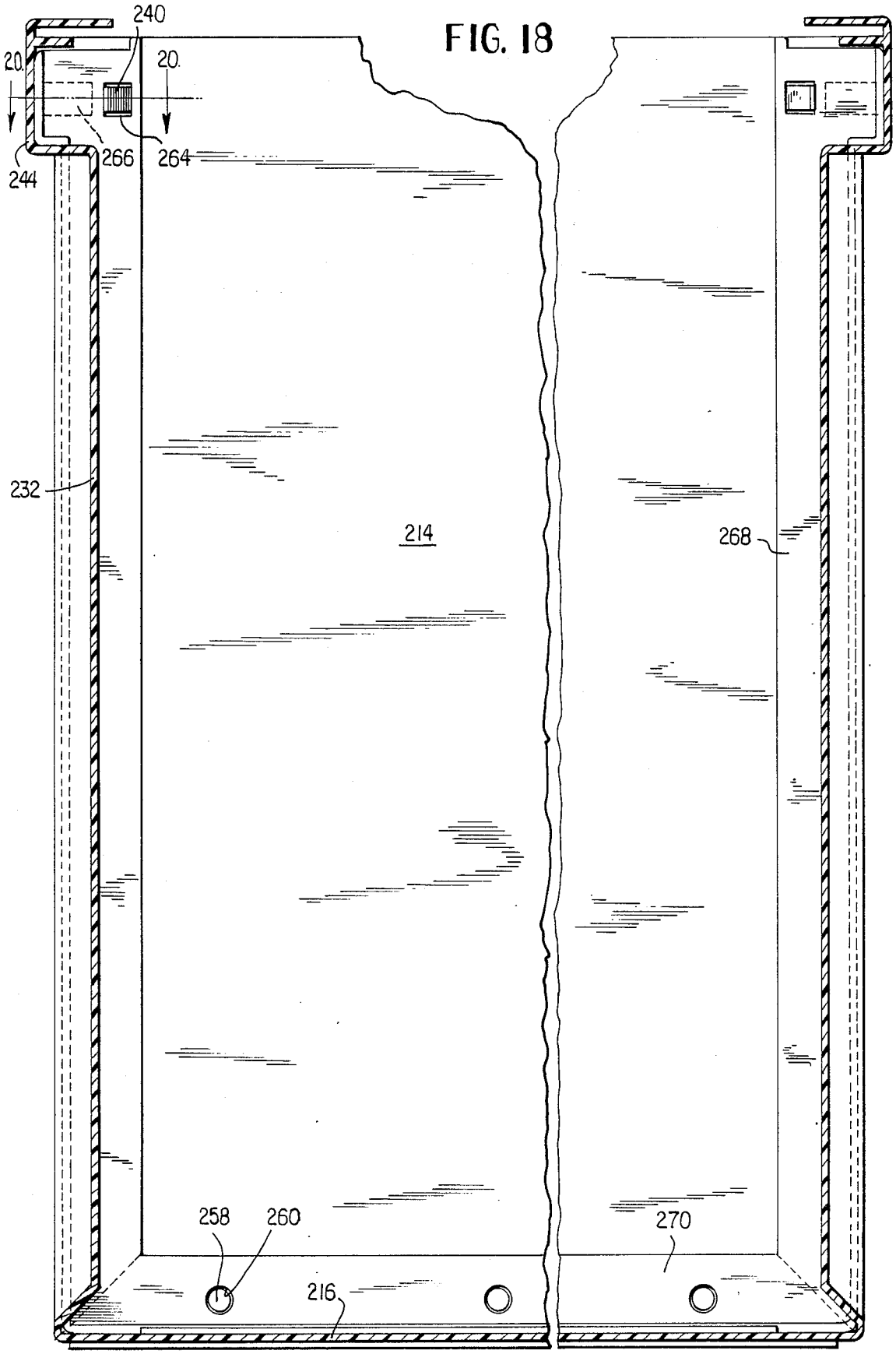
FIGS. 18 and 19 are transverse cross sectional views taken on the lines 18—18 and 19—19, respectively, of FIG. 17, on an enlarged scale relative thereto and with portions of the structure in FIG. 18 being broken away.
Figure 19:
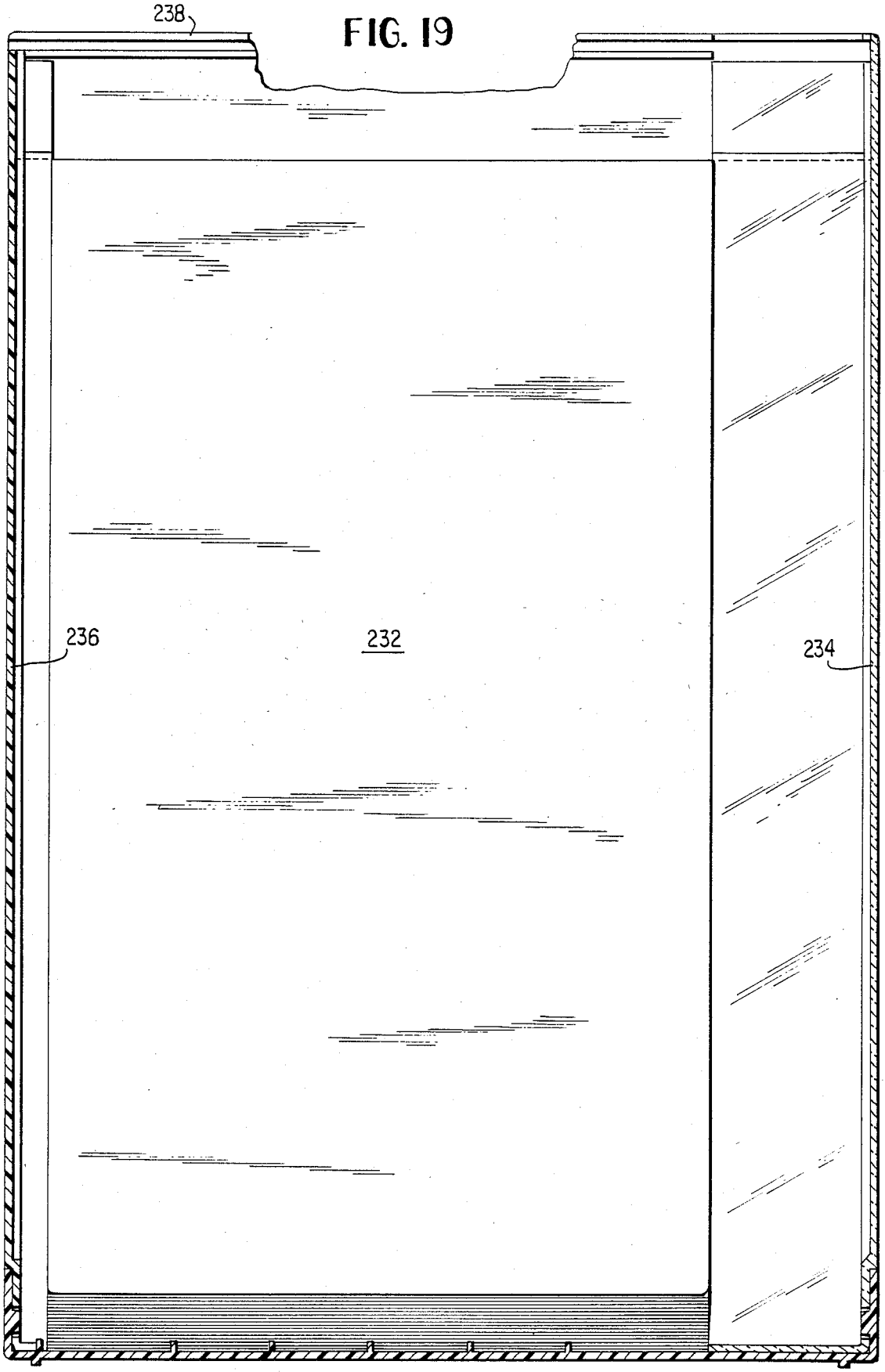

The front and rear panels 154 and 156 each has a central wall 116, 118, respectively, which either may be identical or, as is shown, may differ. With the exception of the central wall, the two panels are identical, however. A lower wall portion 160 and side wall sections 162 extend from the lower and side edges, respectively, of the central wall, these sections being offset therefrom by a distance equal to the width of the side flanges 122, as can be seen in FIG. 12. The two side wall sections are mirror images of one another, each having an upper end portion 164 provided with a rectangular opening 166 and being notched to form a downwardly extending tab 168. Adjacent the lateral edge of the side wall section on the inner face thereof and downwardly spaced from the end portion 164, a lug 170 is provided.

When the drawer of this embodiment is erected, the lower central portions of the wall portions 160 are received between the center panel side flanges 122 and the ribs 124 and the side wall portions 162 between the side panel flanges 134 and ribs 136. The downwardly extending tabs 168 project into the side panel channels 142, the L-shaped flanges 150 extend through the openings 166 and the retaining tab projections 148 engage the inner faces of the side wall portions 162 immediately above the lugs 170.

FIGS. 14 through 20 illustrate a third embodiment of the knockdown drawer or bin of the present invention. The drawer of this embodiment is formed of three components, a bottom and side panel unit 210, front panel 212 and rear panel 214. As in the previously described embodiments, the unit 210 includes a central panel 216 forming the bottom wall of the drawer and including upstanding front and rear flanges 218, 220, and a pair of side wall panels 222 connected to opposite sides of the central panel by reduced thickness hinge zones 224. The central panel ay be of solid rather than grid construction and includes an upwardly projecting rib 226 in spaced, parallel relation to the rear flange 220. A number of cylindrical lugs 228, 230, respectively, are formed at spaced intervals on the inner faces of the front and rear flanges. The two side panels 222 are mirror images of one another, each having a side wall 232 and front, rear and top flanges 234, 236, 238. The front and rear edges of the wall 232 are stepped outwardly to form, with the adjacent flange, channels 240, 242. The top edge of the wall is likewise stepped outwardly forming, with the flange 238, a channel 244. On the inner face of each of the front and rear flanges 234, 236, adjacent the upper end thereof, a wedge-shaped lug 246, 248 is provided.

Front panel 212 includes a front wall 250 the side and lower portions of which 252, 254 are offset by a distance equal to the thickness of the flange 218 of the central panel 216. Flanges 256, 258 extend from the edges of the offset portions, these flanges being of a width substantially equal to the width of the front channel 240 of the side panels 222. Lower offset wall portion 254 is provided with a series of throgh holes 260 corresponding in spacing to the lugs 228 on the flange 218. Each side offset wall portion 252 is stepped outwardly, as indicated by the numeral 262, at the upper end thereof and has a rectangular through opening 264 and, on the outer face thereof, a groove 266 extending laterally from a point closely adjacent the opening to the lateral edge of the wall portion. Rear panel 214 differs in configuration from front panel 212 in that the side and lower flanges 268, 270 are of lesser width, corresponding to the width of the rear channel 242 of the side panel.

Assembly of the drawer of this embodiment involves placing the front and rear panels 212, 214 on the central panel 216 with the openings 260 aligned with and receiving the cylindrical lugs 228. Thereafter, the two side panels 222 are pivoted upwardly to the vertical position. As the side panels approach the vertical, the wedge-shaped projections are guided by the grooves 266 into engagement with the openings 264 at the upper ends of the front and rear panels to lock the side panels to the front and rear panels.

While preferred embodiments of the invention have been illustrated and described in detail herein, it will be understood that changes and additions may be had therein and thereto without departing from the spirit of the invention. Reference should, accordingly, be had to the appended claims in determining the true scope of the invention.

I claim:

1. A knockdown drawer and bin assembly comprising:

a one-piece molded plastic bottom and side panel unit having a rectangular bottom panel with upwardly extending side flanges, and a pair of side panels connected, respectively, to opposite sides of said bottom panel by reduced thickness hinge zones, each side panel having a side wall, end flanges projecting from the lateral edges of said side wall, said side flanges of said bottom panel and said end flanges of said side panels together forming the peripheral portions of the front and rear faces of the assembly in its erected configuration, and, adjacent each upper corner of said side panel, at least one projection attached to and extending inwardly from said end flange; and front and rear panels, each of said front and rear panels being of one-piece molded plastic construction and each having, adjacent the upper corners thereof, at least one opening therein for reception of the corresponding one of said projections.

2. The assembly of claim 1 wherein each of said front and rear panels has end portions and wherein each side panel further includes, adjacent each upper corner of said side wall, a tab defined by a U-shaped notch in said side wall, said tab having an inwardly directed projection for engaging the inner face of the adjacent one of said front and rear panel end portions.

3. The assembly of claim 2 further including a one-piece liner overlying said bottom panel, said side panels and the areas between said front and rear panels and the corresponding edges of said bottom panel.

4. The assembly of claim 1 wherein each of said front and rear panels includes a central wall portion and lower and side wall portions connected to and offset from said central wall portion, said lower and said wall portions abutting the inner faces of said bottom panel side flanges and side panel end flanges, respectively, in the assembled configuration.

5. The assembly of claim 4 wherein said bottom and side panels include ribs spaced from side and end flanges, respectively, to define grooves for reception of said lower and side wall portions.

6. The assembly of claim 4 wherein said side flanges of said bottom panel have inwardly projecting lugs at spaced intervals on the inner face thereof and said lower wall portions include openings for receiving said last-mentioned lugs.

* * * * *